US008819864B2

(12) United States Patent
Hare

(10) Patent No.: US 8,819,864 B2
(45) Date of Patent: Sep. 2, 2014

(54) WADER

(75) Inventor: Shane Hare, Sidney, NE (US)

(73) Assignee: Cabela's Incorporated, Sidney, NE (US)

( * ) Notice: Subject to any disclaimer, the term of this patent is extended or adjusted under 35 U.S.C. 154(b) by 58 days.

(21) Appl. No.: 13/325,744

(22) Filed: Dec. 14, 2011

(65) Prior Publication Data

US 2013/0152263 A1 Jun. 20, 2013

(51) Int. Cl.
*A41F 15/02* (2006.01)

(52) U.S. Cl.
USPC ..... 2/79; 2/338; 2/82

(58) Field of Classification Search
USPC ..... 2/46, 227, 230, 82, 79, 22, 310–333, 2/338, 340
See application file for complete search history.

(56) References Cited

U.S. PATENT DOCUMENTS

| | | | | | |
|---|---|---|---|---|---|
| 721,305 | A * | 2/1903 | Hunkins | 2/310 |
| 1,894,888 | A * | 1/1933 | Ponton | 2/323 |
| 3,206,767 | A * | 9/1965 | Meisberger | 2/333 |
| 4,850,057 | A * | 7/1989 | Schierenbeck | 2/328 |
| 4,923,105 | A * | 5/1990 | Snyder | 224/255 |
| 4,947,870 | A * | 8/1990 | Larcher | 128/875 |
| 4,967,421 | A * | 11/1990 | Grilliot et al. | 2/327 |
| RE34,094 | E * | 10/1992 | Grilliot et al. | 2/327 |
| 5,168,582 | A * | 12/1992 | Aldridge | 2/305 |
| 6,167,571 | B1 * | 1/2001 | Cheng | 2/227 |
| 6,427,252 | B1 * | 8/2002 | Lewis et al. | 2/326 |
| 6,668,383 | B2 * | 12/2003 | Rausch et al. | 2/82 |
| 6,979,303 | B2 * | 12/2005 | Jestrabek-Hart | 602/4 |
| 7,500,273 | B2 * | 3/2009 | Dana | 2/79 |
| 7,628,157 | B2 * | 12/2009 | Kosh | 128/874 |
| 2007/0043313 | A1 * | 2/2007 | Avon | 602/20 |
| 2010/0306897 | A1 * | 12/2010 | Wood et al. | 2/79 |
| 2011/0307993 | A1 * | 12/2011 | McAfee | 2/82 |

OTHER PUBLICATIONS

Cabela's Catelog, vol. XX, Limited Fall Ed. 2012, pp. 450, 461, 464, 467.

* cited by examiner

*Primary Examiner* — Khoa Huynh
*Assistant Examiner* — Andrew W Collins
(74) *Attorney, Agent, or Firm* — Quarles & Brady LLP

(57) ABSTRACT

A wader is disclosed. The wader includes a bib including a front and a rear portion, and a shoulder strap configured to couple to either the front portion of the bib or the rear portion of the bib. The wader includes an adapter strap configured to couple between the shoulder strap and either the front portion of the bib or the rear portion of the bib. The adapter strap is configured to support both a left side and a right side of the bib when the adapter strap is coupled to either the front portion of the bib or the rear portion of the bib. In some implementations, the adapter strap includes a first buckle configured to couple to the shoulder strap and the bib, a second buckle configured to couple to the bib, and a third buckle configured to couple to the bib.

13 Claims, 8 Drawing Sheets

WADER

FIELD OF THE INVENTION

The disclosure relates in general to a wader and, more particularly, to a wader utilizing an adjustable shoulder strap system.

BACKGROUND OF THE INVENTION

Waders are generally a waterproof article of clothing worn by hunters, anglers, and others who wish to spend time in relatively harsh environments. By combining a waterproof boot that extends to cover the wearer's legs, waist, and chest, waders can prove to be essential equipment to ensure the wearer remains comfortable when fishing in cold rivers or streams, wading through ponds or marshland, or simply trying to stay warm and protected from the elements.

Conventional waders can include waterproof materials such as vulcanized rubber, neoprene, Gore-Tex®, waterproof breathable fabrics, coated nylons, polyvinylchloride materials, rubber, combinations thereof or any other materials suitable for use in combination with a wader garment. The waders are constructed to provide a rugged boot for the wearer, as well as to cover the wearer's legs and a portion of the wearer's chest. Pockets are often positioned around the exterior of the wader to allow the wearer to store useful articles such as fishing equipment (e.g., lures, lines, etc.), hunting equipment (e.g., ammunition, chokes, etc.) or other equipment.

In many cases, conventional waders are cumbersome, making it difficult for the wearer to maneuver precisely, quickly, or comfortably. Additionally, to ensure that the waders do not fall down, a combination of straps are positioned over each of the wearer's shoulders to ensure that the waders remain in place.

SUMMARY OF THE INVENTION

The disclosure relates in general to a wader and, more particularly, to a wader utilizing an adjustable shoulder strap system.

In one implementation, the present invention is a wader including a bib including four strap attachment points. Two of the four strap attachment points are positioned at a front of the bib and two of the four strap attachment points are positioned at a rear of the bib. The wader includes a shoulder strap including two buckles. Each one of the two buckles of the shoulder strap is configured to couple to any one of the four strap attachment points of the bib. The wader includes an adapter strap including a first buckle configured to couple to any one of the two buckles of the shoulder strap, and a second buckle connected to the first buckle. The second buckle is configured to couple to any one of the four strap attachment points of the bib. The adapter strap includes a third buckle connected to the first buckle. The second buckle is configured to couple to any one of the four strap attachment points of the bib. The adapter strap is configured to support both a left side and a right side of the bib when the second and third buckles are connected to either the two strap attachment points at the front of the bib or the two strap attachment points at the rear of the bib.

In another implementation, the present invention is a wader including a bib including a front and a rear portion, a shoulder strap configured to couple to either the front portion of the bib or the rear portion of the bib, and an adapter strap configured to couple between the shoulder strap and either the front portion of the bib or the rear portion of the bib. The adapter strap is configured to support both a left side and a right side of the bib when the adapter strap is coupled to either the front portion of the bib or the rear portion of the bib.

In another implementation, the present invention is a wader including a bib including a front and a rear portion, and a shoulder strap configured to couple to one of the front and rear portion of the bib at a single attachment point, and couple to the other of the front and rear portion of the bib at two attachment points.

DETAILED DESCRIPTION OF THE DRAWINGS

The disclosure relates in general to a wader and, more particularly, to a wader utilizing an adjustable shoulder strap system.

Figure 1:
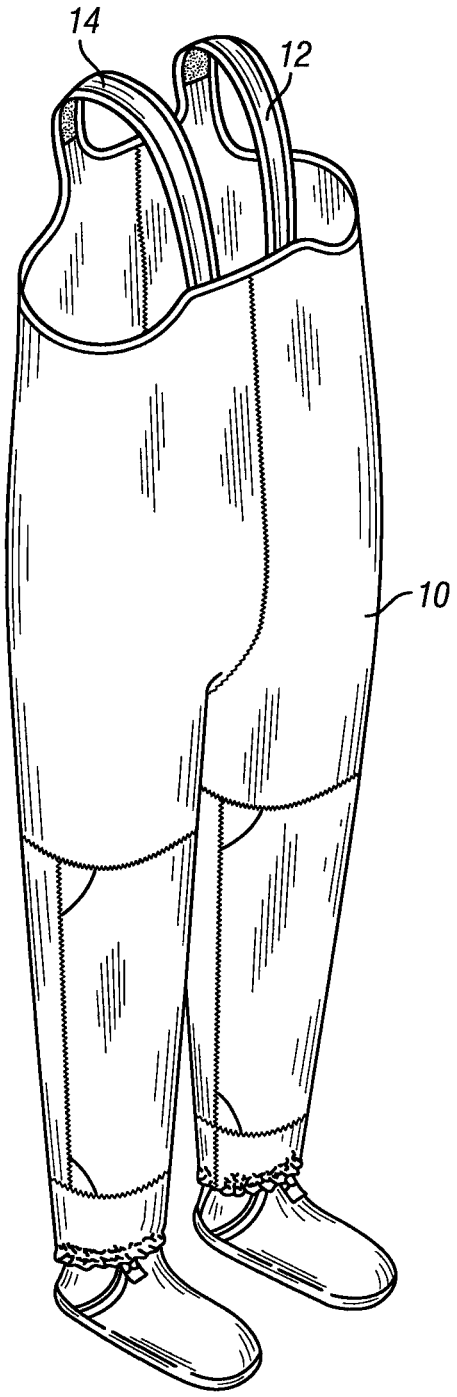
FIG. 1 (Prior Art)
FIG. 1 is an illustration of a prior art wader system comprising two separate should straps.

Conventional waders use a dual shoulder strap system to ensure that the waders remain supported during use. FIG. 1 is an illustration of a conventional wader. As shown in FIG. 1, two separate straps or loops are mounted to an upper region of wader 10. Strap 12 is mounted to a left hand portion of the upper or bib region of wader 10, while strap 14 is mounted to the right hand portion. In such a configuration, when wader 10 is worn, strap 12 is placed over the left shoulder of the wearer, while strap 14 is placed over the right shoulder of the wearer.

In the arrangement shown in FIG. 1, the two shoulder straps prevent wader 10 from falling downwards when wader 10 is worn and provide equal support to each side of the bib of wader 10. Unfortunately, the dual-shoulder strap arrangement presents some problems. Because the straps are necessarily quite thick and sturdy (to provide some degree of padding and ruggedness), they can interfere with the shouldering of a weapon when hunting. When shouldering a shotgun, for example, if the shoulder straps include a relatively thick padding, that padding can interfere with the placement of the shotgun, possibly resulting in an inaccurate or uncomfortable shot. If the shoulder straps were to not include such padding, then the wearer may be uncomfortable when wearing the wader as the straps could dig in to the wearer's shoulders.

Additionally, because each shoulder strap is required to support at least a portion of the weight of wader 10 and any equipment stored in pockets of wader 10, each strap necessarily pulls down upon each of the wearer's shoulders. That additional weight can make it difficult for the wearer to easily move each of his or her arms. When casting a fishing rod, for example, the straps interfere with the movement of the wearer's arm making fishing excessively tiring and difficult.

In some cases, because of the problems associated with the dual strap arrangement, a wearer may simply slide one of the shoulder straps off so that the wader is only supported by a single shoulder strap. Although this can mitigate some of the problems associated with dual-strap systems, this arrangement presents additional problems and difficulties for the wearer.

Because a dual strap wader is manufactured on the presumption that both shoulder straps will be worn by a wearer, the wader is not properly supported when only a single strap is worn. As a result, when only a single strap is worn the portion of the wader's bib on the side from which the support was removed will hang downwards. In addition to being uncomfortable, this can interfere severely with the operation of the garment. If one side of the bib should hang downwards, the bib will hang open on that side allowing cold air and possibly cold water to enter the garment. This, of course, can severely reduce the heat insulation and waterproof capabilities of the garment.

Additionally, because many waders incorporate open pockets, with the opening of the pockets oriented upwards, the removal of one of the shoulder strap can greatly increase the likelihood that an object will be lost from one of those pockets. If a shoulder strap is removed by the wearer, the pockets on that side of the garment will hang downwards, resulting in their openings being oriented more towards the side of the wearer and away from the head of the wearer. As a result, if the wearer should lean over to that side, the pocket could easily become positioned so that objects disposed therein could fall out.

The present system, therefore, provides a wader utilizing an adjustable strap system that allows for the wearer to wear either one or both shoulder straps of a wader. The strap system is arranged to provide full support to the wader so that the entire wader is maintained in position, even when only a single strap is used. In some cases, the wader may even be used with two shoulder straps, in accordance with conventional wader arrangements.

As such, the present system provides an improved wader strap system that mitigates the problems associated with conventional waders, as described above. The optional use of a single strap allows for the accurate and unimpinged shouldering of a weapon, should the wader be used by a hunter, or casting of a fishing rod, should the wader be used by a fisherman. Similarly, a single strap arrangement can facilitate any other activities involving the movement of the wearer's arms and can be selectively used to reduce a weight load on one of the wearer's shoulders. Because the wader is configured so that a single strap can be used to provide comprehensive support to the wader, the bib portion of the wader is maintained in its proper arrangement. As such, the fit of the wader, and consequently the heat-insulative properties of the wader, are not affected by the use of a single shoulder strap. Additional, the integrity and positioning of pockets or other structures disposed about the bib portion of the present wader are not affected by the use of a single shoulder strap.

Figure 2A:
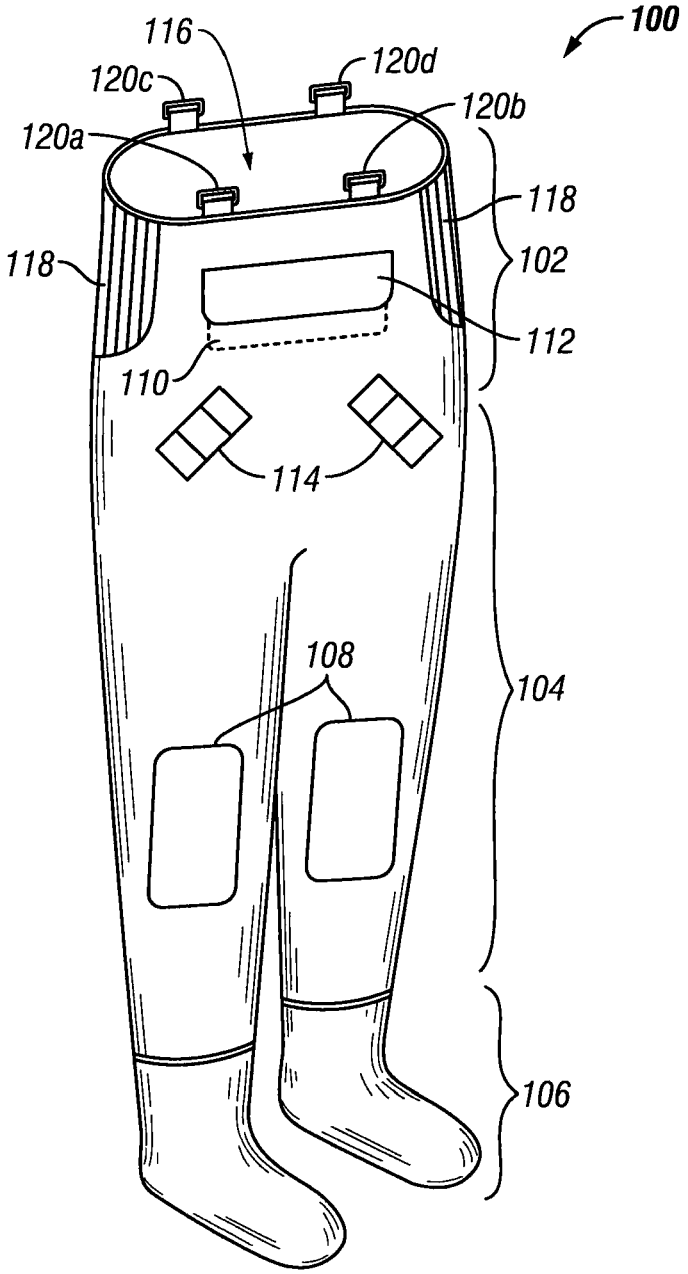
FIG. 2A is an illustration of a bib having legs and boots and arranged in accordance with the present wader.

FIG. 2A is an illustration of bib 102, legs 104, and boots 106 of the present wader 100. Boots 106 includes rugged materials allowing the wearer to walk through relatively rough terrain. Boots 106 can include padded inserts to provide comfort to the wearer's feet, while simultaneously providing sufficient support to the wearer's ankles to prevent injury when crossing uneven terrain.

Boots 106 are waterproof and can be sealed to legs 104 to prevent water entering waders 100 through either boots 106 or the connection between boots 106 and legs 104. The connection between boots 106 and 104 may include a heat-sealed or bonded material to ensure a waterproof connection. Boots 106 and 104 may also be connected to wader 100 using glues, tapes, or other fixing or coupling materials. Alternatively, legs 104 may include an elastic cuff that is stretched over a portion of boots 106. In that case, the elastic cuff may be sufficiently snug to prevent water from entering one of legs 104. Wader 100 may also include a stocking foot arrangement, wherein the stocking foot of the wader is configured to be inserted into a non-waterproof boot.

Legs 104 and bib 102 each include waterproof materials such as vulcanized rubber, neoprene, Gore-Tex®, waterproof breathable fabrics, coated nylons, polyvinylchloride materials, rubber, or combinations thereof or any other materials suitable for use in combination with a wader garment (even possibly including non-waterproof materials). The materials can incorporate surface patterns or designs depending upon their anticipated use (e.g., camouflage patterns, light reflective materials for ease of viewing at night, bright colors for ease of viewing during the day, and the like). In one implementation, various portions of legs 104 and bib 102 incorporate heat-reflective material synthetic materials to provide improved thermal insulation for the wearer. The heat-reflective material may form an inner layer of legs 104 and bib 102 of wader 100, while a suitable waterproof material forms an exterior layer. In such an arrangement, the wearer is afforded substantial thermal insulation, while still being protected from water.

Legs 104 are sized based upon the anticipated dimensions of the user. Optional knee pads 108 may be attached to the outer surface of legs 104, or disposed within one or more layers of material making up legs 104. Knee pads 108 provide protection to the knees of the wearer when kneeling or crawling upon the ground, for example. In one implementation, knee pads 108 include a molded neoprene material connected to the outer surface of legs 104.

Bib 102 portion of wader 100 is sized to be positioned around the waist and chest of the wearer. In some cases, bib 102 may incorporate a belt or belt loops to allow for wader 100 to be fitted relatively snugly around the wearer's waist. A number of pockets or pouches may be attached to the outer surface of bib 102. For example, with reference to FIG. 2A, pocket 110 is formed within the front surface of bib 102. Flap 112 is positioned over the pocket to prevent items from accidentally falling out of pocket 110. Depending upon the implementation, flap 112 may include Velcro, buckles, zips, or other fasteners to prevent flap 112 from unintentionally moving upwards or opening thereby exposing the interior of pocket 110.

A number of additional pouches or shell loops 114 may be formed over the surface of bib 102. Pouches 114, for example, may include openings sized to receive ammunition shells and can be formed at an angle to facilitate their use.

In various implementations of wader 100, any number of pouches, pockets, bags, or other receptacles could be mounted to, or formed within, bib 102 or legs 104 of wader 100. For example, bib 102 may incorporate hard warming pockets that are configured to accept heat generating packets as well as the wearer's hands.

To ensure that opening 116 of bib 102 is formed snugly around the chest of the wearer, bib 102 may incorporate a number of elasticated or side-stretch sections 118. The elasticated sections 118 are configured to ensure that the opening 116 of bib 102 is formed snugly around the wearer. By fitting snugly, the thermal insulation and waterproof properties of wader 100 are maximized—otherwise cold air and/or water could enter wader 100 through gaps between bib 102 and the wearer.

Figure 2B:
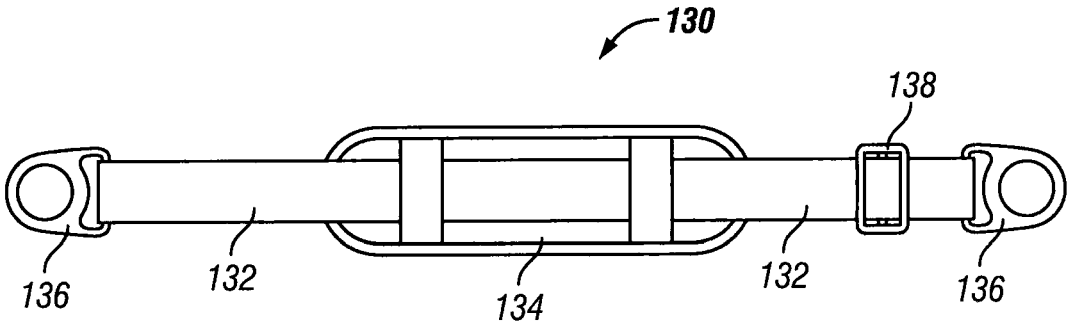
FIG. 2B is an illustration of a shoulder strap for use in conjunction with the present wader system.
Figure 2C:
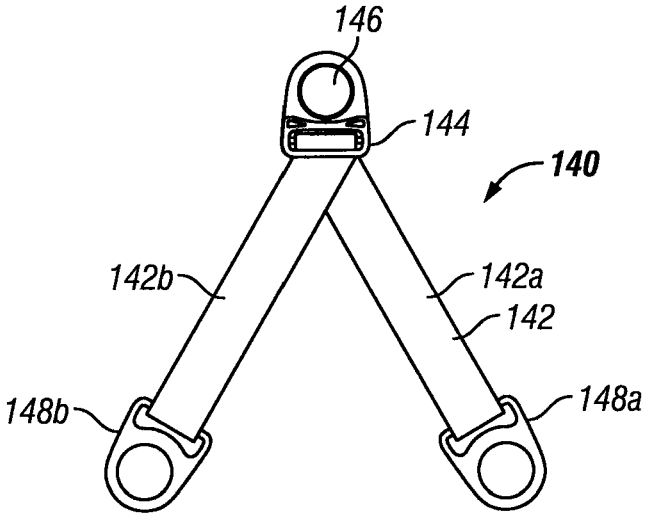
FIG. 2C is an illustration of an adapter strap for use with a shoulder strap in conjunction with the present wader system.

Buckles 120*a*-120*d* are positioned around opening 116 of wader 100. Buckles 120 are configured to couple with complimentary buckles of a number of straps, as illustrated in FIGS. 2B and 2C. In various implementations of wader 100, buckles 120 may include any suitable fastener for connecting to one or more straps configured in accordance with the present disclosure. For example, buckles 120 may include swivel buckles, snaps, clasps, clips, cam locks, hook and look fasteners, or other mechanisms for connecting to one or more shoulder straps or adapter straps, as illustrated in FIGS. 2B and 2C.

FIG. 2B is an illustration of shoulder strap 130 for use with wader 100. Strap 130 includes strap 132 comprising a strong material such as a fabric or leather. In some cases, strap 132 includes a weaved nylon to provide great linear strength. Shoulder pad 134 is connected to strap 132 and is configured to be selectively positioned along the length of strap 132. By positioning shoulder pad 134 at a preferred location, the wearer can ensure that shoulder pad 134 is positioned over the wearer's shoulder in a manner so as to minimize an amount of pressure applied thereto.

At either end of strap 132, shoulder strap 130 includes buckles 136. Buckles 136 are configured to selectively couple to any of buckles 120 of bib 102 (see FIG. 2A) or buckles 146 and/or 148 of adapter strap 140 as shown in FIG. 2C. Buckles 120 may include swivel buckles, snaps, clasps, clips, hook and look fasteners, or other fastening mechanisms for connecting to any of buckles 136, 146 and/or 148. Shoulder strap 130 also include a sliding buckle 138 for adjusting the overall length of strap 132 of shoulder strap 130.

One or more shoulder strap 130 may be used in conjunction with wader 100 to allow wader 100 to be worn in either a single shoulder, or double shoulder arrangement.

FIG. 2C is an illustration of adapter strap 140 for use with shoulder strap 130 in wader 100. Adapter strap 140 includes strap 142 comprising a strong material such as a fabric or leather. In some cases, strap 142 includes a weaved nylon to provide great linear strength. Strap 142 is threaded through adjustable buckle 144. Adjustable buckle 144 allows the two lengths of strap 142 (i.e., 142*a* and 142*b*) to be adjusted. If length 142*a* is decreased, length 142*b* is increased, and vice versa. Buckle 146 is connected to adjustable buckle 144. Buckles 148*a* and 148*b* are connected to lengths of strap 142*a* and 142*b*, respectively.

Buckles 146 and 148 may include swivel buckles, snaps, clasps, clips, hook and look fasteners, or other fastening mechanisms for connecting to any of buckles 120 and/or 136.

By using a combination of one or more shoulder straps 130 and adapter straps 140, wader 100 can be used with a number of different shoulder strap arrangements. As discussed below, the strap system allows for a number of single-shoulder arrangements for use with wader 100. Alternatively, a pair of shoulder straps 130 may be used in order to user wader 100 in a dual strap arrangement.

Figure 3A:
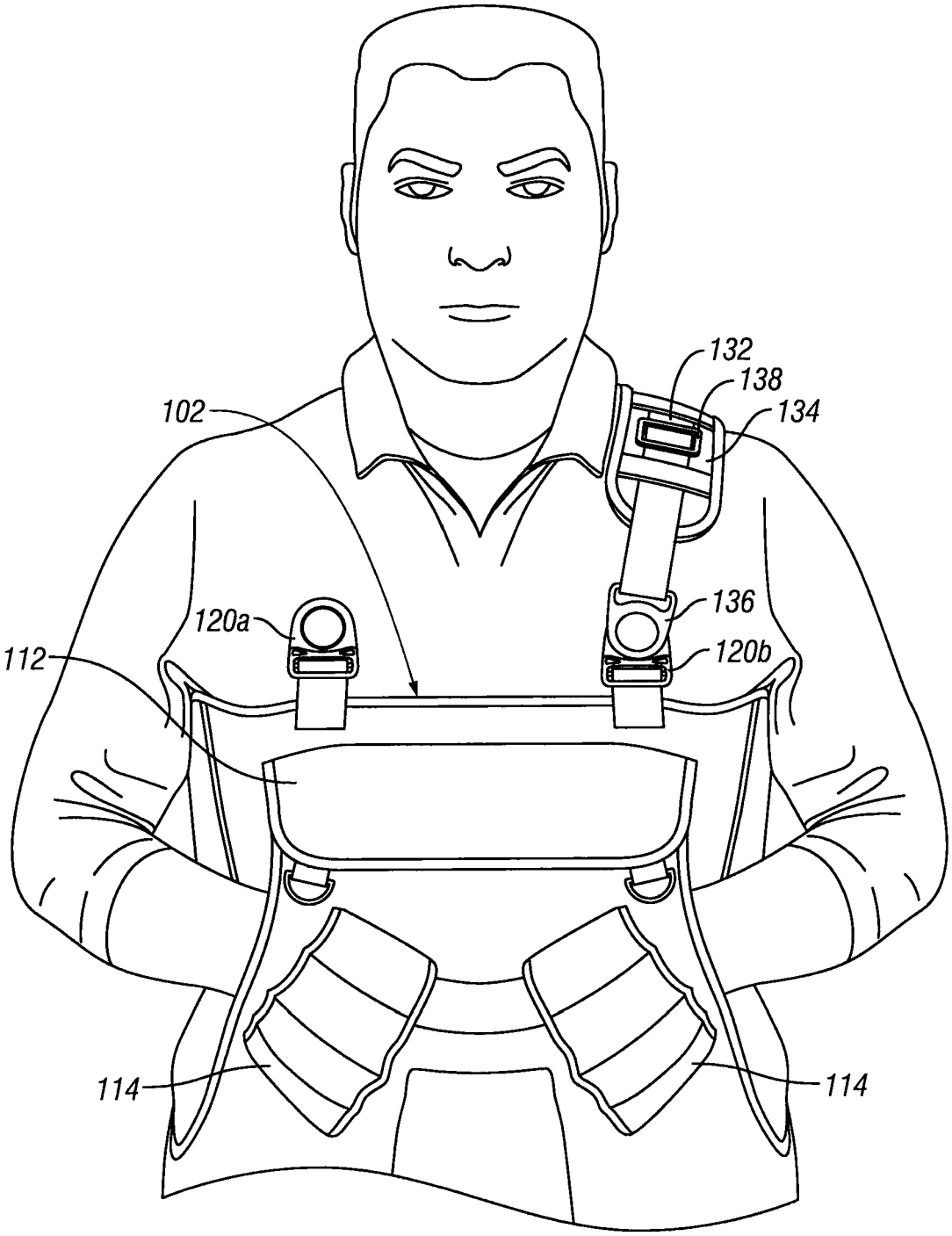
FIG. 3A is an illustration showing a front view of the present wader system in a single shoulder strap configuration having a single front attachment.
Figure 4A:
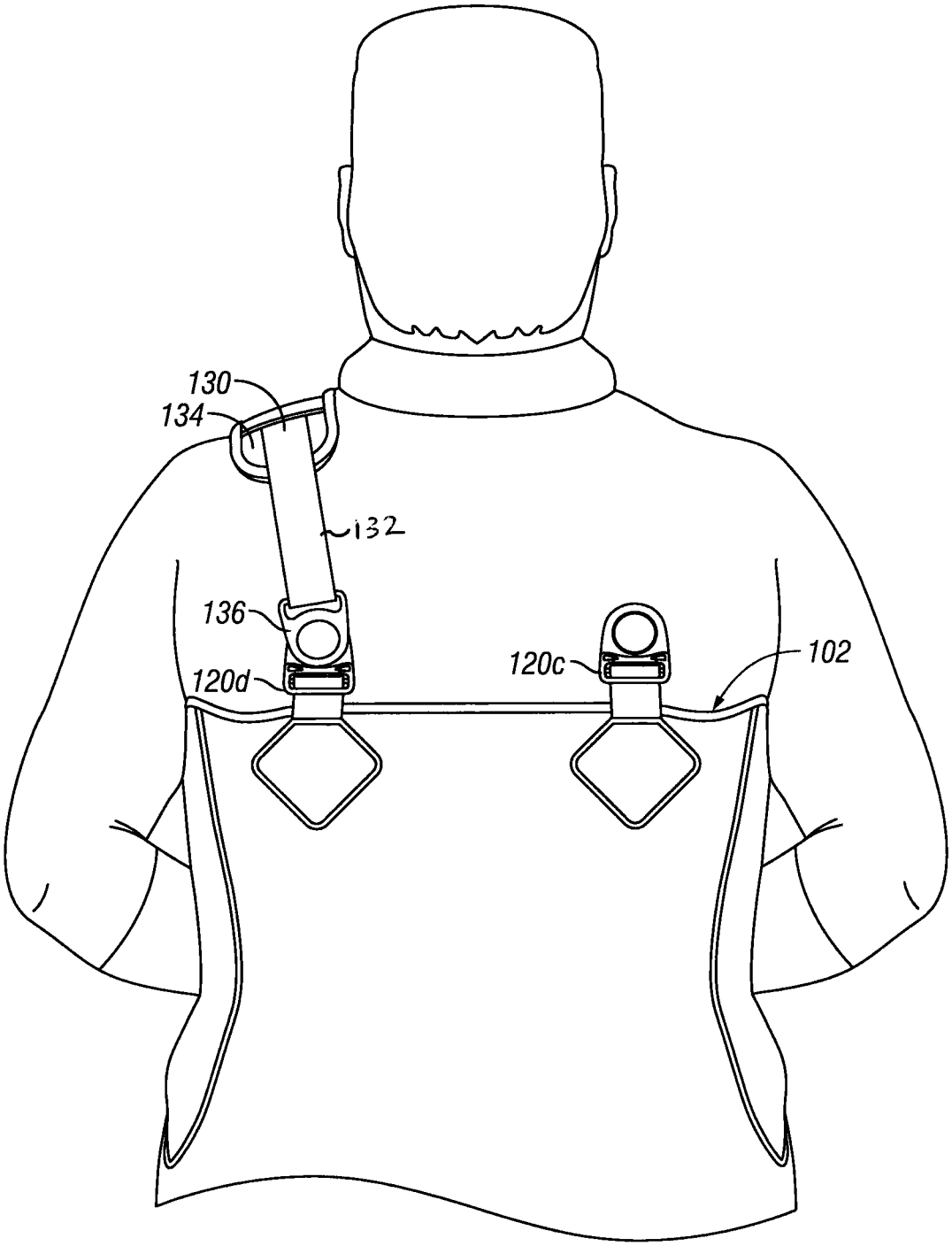
FIG. 4A is an illustration showing a rear view of the present wader system in a single shoulder strap configuration having a single rear attachment.
Figure 4B:
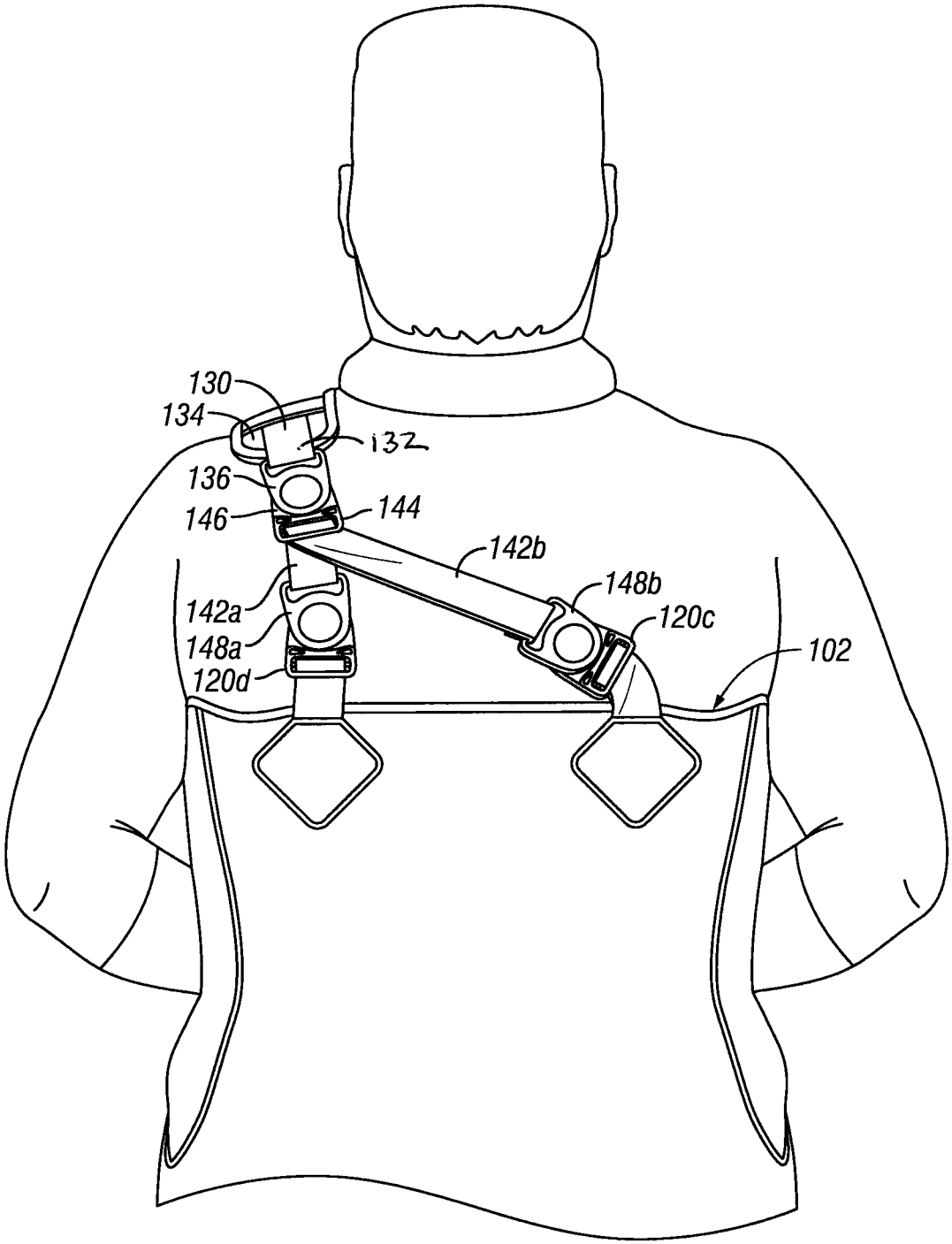
FIG. 4B is an illustration showing a rear view of the present wader system in a single shoulder strap configuration having a double rear attachment.

FIGS. 3A and 4B show an implementation of the present wader system having a single shoulder strap with a single front attachment and a double rear attachment. FIG. 3A is an illustration showing a front view of the wader. In FIG. 3A one of buckles 136 of shoulder strap 130 is shown connected directly to buckle 120*b* of bib 102 of wader 100. Additionally, shoulder pad 134 of shoulder strap is shown positioned over the wearer's shoulder to provide comfort and additional support. In the arrangement shown in FIG. 3A, buckle 120*a* of bib 102 is not connected to a strap.

In FIG. 4B, shoulder strap 130 is shown connected to bib 102 of wader 100 via adapter strap 140. As shown in FIG. 4B, shoulder strap 130 is positioned over the wearer's shoulder (with shoulder pad 134 being appropriately positioned) with one of buckles 136 being connected to buckle 146 of adapter strap. Buckles 148*a* and 148*b* are then connected to bib 102. Buckle 148*a* of adapter strap 140 is connected to buckle 120*d* of bib 102, while buckle 148*b* is connected to buckle 120*c* of bib 102.

Because adapter strap 140 is connected to both buckles 120*c* and 120*d* of bib 102, adapter strap 140 provide support to both the left and ride sides of bib 102 even though shoulder strap 130 is only worn on one shoulder.

To provide favorable performance, the lengths of sections 142*a* and 142*b* of adapter strap 140 are selected so as to provide equal support to both sides of bib 102. In the implementation shown in FIG. 4B, the ratio of length 142*b* to 142*a* is approximately two to one. For example, the length of strap 142*b* may be 6 inches while the length of strap 142*a* is 3 inches. Alternatively, the length of strap 142*b* may be 8 inches while the length of strap 142*a* is 4 inches. In such a configuration, even with a single strap placed across one shoulder of the wearer, both sides of the vest can receive adequate support.

Figure 3B:
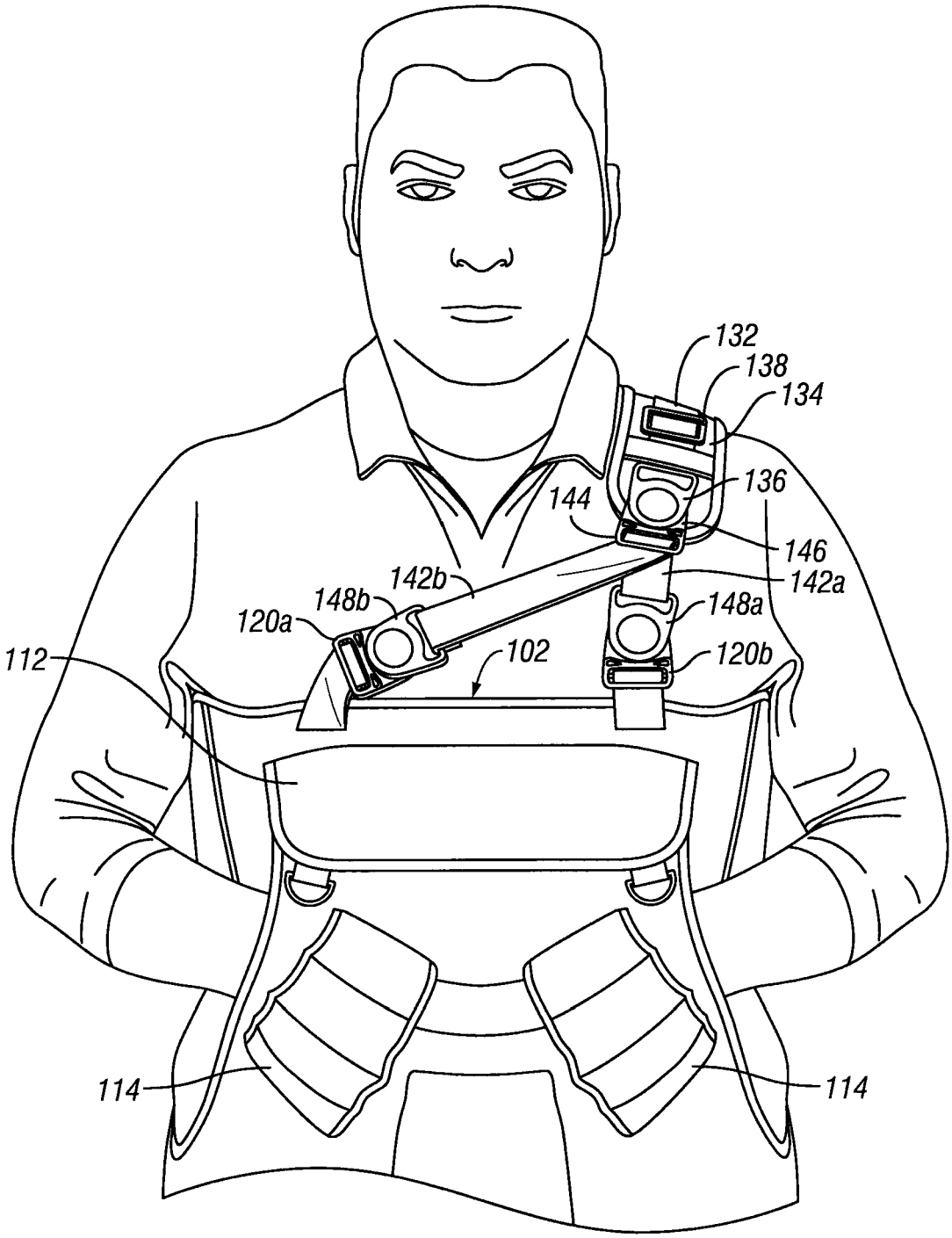
FIG. 3B is an illustration showing a front view of the present wader system in a single shoulder strap configuration having a double front attachment.

FIGS. 3B and 4A show an implementation of the present wader system having a single shoulder strap with a double front attachment and a single rear attachment. In FIG. 3B, shoulder strap 130 is connected to bib 102 of wader 100 via adapter strap 140. As shown in FIG. 3B, shoulder strap 130 is positioned over the wearer's shoulder (with shoulder pad 134 being appropriately positioned) with one of buckles 136 being connected to buckle 146 of adapter strap. Buckles 148*a* and 148*b* are then connected to bib 102. As shown in FIG. 3B, buckle 148*a* of adapter strap 140 is connected to buckle 120*b* of bib 102, while buckle 148*b* is connected to buckle 120*a* of bib 102.

Because adapter strap 140 is connected to both buckles 120*a* and 120*b* of bib 102, adapter strap 140 provide support to both the left and ride sides of bib 102 even though shoulder strap 130 is only worn on one shoulder.

Figure 5:
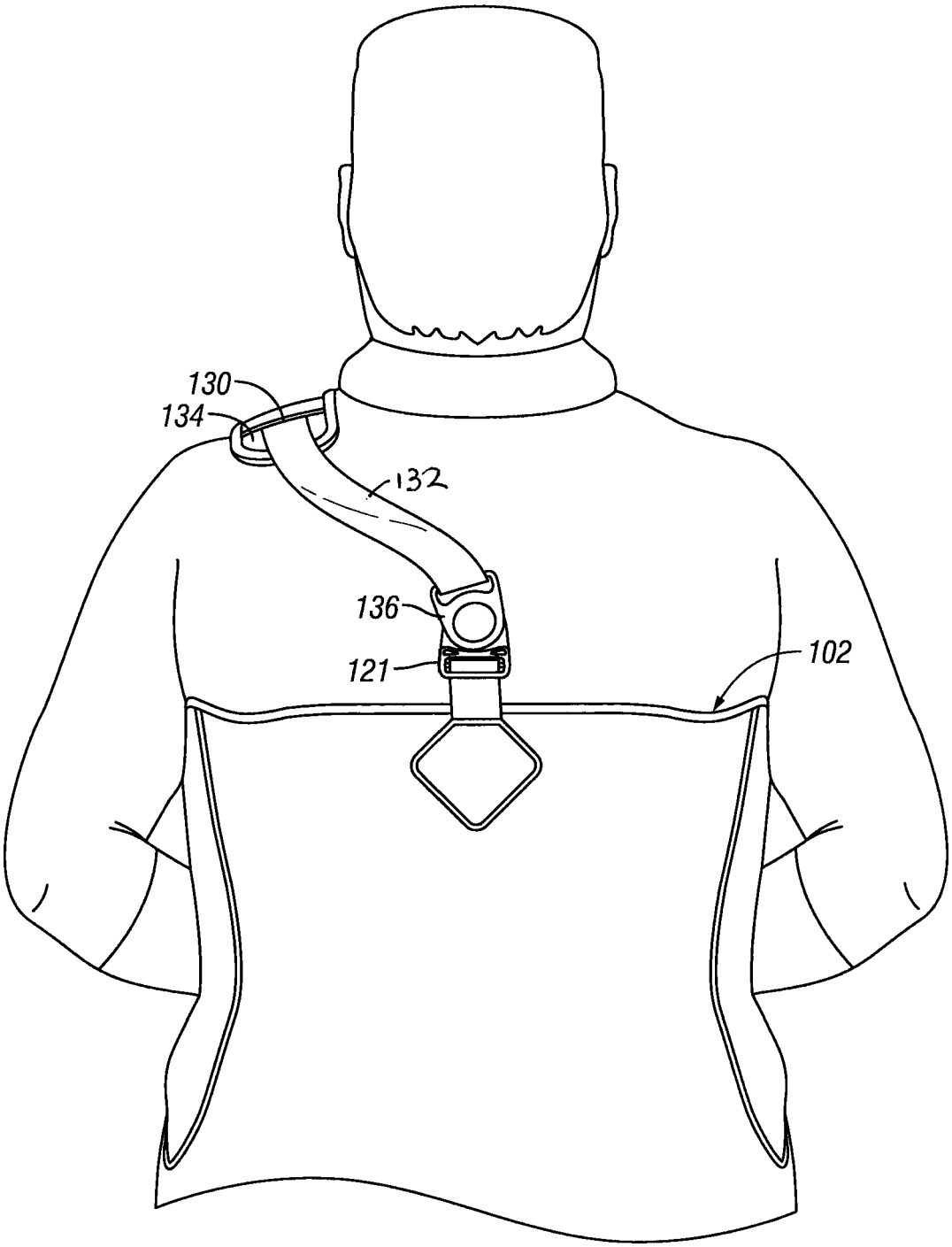
FIG. 5 is an illustration showing a rear view of the present wader system in a single shoulder strap configuration having a single centered rear attachment.

As shown in FIG. 4A, one of buckles 136 of shoulder strap 130 is shown connected directly to buckle 120*d* of bib 102 of wader 100. Additionally, shoulder pad 134 of shoulder strap 130 is shown positioned over the wearer's shoulder to provide comfort and additional support. In the arrangement shown in FIG. 4A, buckle 120*c* of bib 102 is not connected to a strap. In an alternative implementation, as shown in FIG. 5, wader 100 may only include a single, centered buckle 121 for connecting to one of buckles 136 of shoulder strap 130.

To provide favorable performance, the lengths of sections 142*a* and 142*b* of adapter strap 140 are selected so as to provide equal support to both sides of bib 102. In the implementation shown in FIG. 3B, the ratio of length 142*b* to 142*a* is approximately two to one. For example, the length of strap 142*b* may be 6 inches while the length of strap 142*a* is 3 inches. Alternatively, the length of strap 142*b* may be 8 inches while the length of strap 142*a* is 4 inches. In such a configuration, even with a single strap placed across one shoulder of the wearer, both sides of the vest can receive adequate support.

As described above, wader 100 can be worn in a number of arrangements allowing for the use of only a single shoulder strap 130, while provide adequate support to both sides of bib 102 portion of wader 100. For example, wader 100 may be worn with a single shoulder strap having a single connection to a front buckle of bib 102 (e.g., FIG. 3A), while being connected, via an adapter strap 140, to two locations (e.g., both buckles 120*c* and 120*d*) in the rear of bib 102 (e.g., FIG. 4B). In that arrangement, although bib 102 is only supported by a single buckle at the front of bib 102, the bib 102 is fully supported on both sides at the rear of bib 102.

Alternatively, wader 100 may be worn with a single shoulder strap having a single connection to a rear buckle of bib 102 (e.g., FIG. 4A or FIG. 5), while being connected, via an adapter strap 140, to two locations (e.g., both buckles 120*a* and 120*b*) at the front of bib 102 (e.g., FIG. 3B). In that arrangement, although bib 102 is only supported by a single buckle at the rear of bib 102, the bib 102 is fully supported on both sides at the front of bib 102.

Alternatively, wader 100 may be worn with a single shoulder strap having double connections in both the front and the rear of bib 102 (e.g., FIGS. 3B and 4B). In that case, shoulder strap 130 is connected to both buckles 120*a* and 120*b* at the front of bib 102 via an adapter strap 140, as shown in FIG. 3B. Similarly, at the rear of bib 102, shoulder strap 130 is connected to both buckles 120*c* and 120*d* using a second adapter strap 140, as shown in FIG. 4B. In that arrangement, both the left and right side of bib 102 of wader 100 are support in both the bib 102's front and rear locations. This arrangement, therefore, provides substantial support to both sides of bib 102, while only requiring a single shoulder strap.

Wader 100 can also be worn with a single shoulder strap having a single connection to a front buckle of bib 102 (e.g., FIG. 3A), while also being connected to a single rear buckle of bib 102 (e.g., FIG. 4A). In that arrangement, in both front and rear locations, bib 102 is only supported by a single buckle. Although this doesn't provide for optimal support to both sides of bib 102, the present wader system is sufficiently flexible to allow for such an arrangement.

Finally, in circumstances where a wearer wishes to utilize wader 100 in a dual-strap arrangement, the user can connect a first shoulder strap 130 between buckles 120*b* and 120*d* of bib 102 and second shoulder strap 130 between buckles 120*a* and 120*c*. Each shoulder strap 130 can then be worn across one of the wearer's shoulders.

Although FIGS. 3A-3B and 4A-4B each show wader 100 in a single strap arrangement showing a shoulder strap 130 placed across the wearer's left shoulder, it should be readily appreciated by a person of ordinary skill in the art that similar arrangement may be used to provide for a single strap configuration wherein the single strap is worn across the wearer's right shoulder. In other words, arrangements of wader 100 that are the mirror image of those shown in FIGS. 3A-3B and 4A-4B can be used.

Additionally, referring to FIGS. 3A-3B and 4A-4B, depending upon the desired flexibility of the system, any of the buckles combinations described can be replaced by fixed connections. For example, with reference to FIG. 3A, strap 130 may be permanently fixed to bib 102 at the location shown without incorporating a releasable buckle. Similarly, any of the other connections described between one or more shoulder straps 130, adapter straps 140 and buckles of bib 102 may be replaced by fixed connections.

Although the present invention has been described with respect to preferred embodiment(s), any person skilled in the art will recognize that changes may be made in form and detail, and equivalents may be substituted for elements of the invention without departing from the spirit and scope of the invention. Therefore, it is intended that the invention not be limited to the particular embodiments disclosed for carrying out this invention, but will include all embodiments falling within the scope of the appended claims.

What is claimed is:

1. A wader, comprising:

a bib including four strap attachment buckles, wherein two of the four strap attachment buckles are positioned at a front of the bib and two of the four strap attachment buckles are positioned at a rear of the bib, one of the front strap attachment buckles being positioned at a right side of the bib and the other being positioned at a left side of the bib, and one of the rear strap attachment buckles being positioned at the right side of the bib and the other being positioned at the left side of the bib;

only a single shoulder strap including two buckles, wherein each one of the two buckles of the shoulder strap is configured to releasably couple to any one of the four strap attachment buckles of the bib, wherein the wader does not include a second shoulder strap; and an adapter strap, including:

a first buckle configured to releasably couple to any one of the two buckles of the shoulder strap, a second buckle connected to the first buckle, the second buckle being configured to releasably couple to any one of the four strap attachment buckles of the bib, and a third buckle connected to the first buckle, the third buckle being configured to releasably couple to any one of the four strap attachment buckles of the bib, wherein the shoulder strap is configured to support both the left side and the right side of the bib when the first buckle of the adapter strap is connected to one of the buckles of the shoulder strap and the second and third buckles of the adapter strap are connected to either the two strap attachment buckles at the front of the bib or the two strap attachment buckles at the rear of the bib while the other buckle of the shoulder strap is connected to a single one of the two strap attachment buckles at a side of the bib other than the side having the strap attachment buckles to which the second and third buckles are connected.

2. The wader of claim 1, wherein the two buckles of the shoulder strap include swivel buckles.

3. The wader of claim 1, wherein the adapter strap includes an adjustable buckle.

4. The wader of claim 3, wherein the adjustable buckle is configured to adjust a length of material extending to at least one of the second buckle and third buckle.

5. A wader, comprising:

a bib including a front and a rear portion, wherein the front portion includes a plurality of connectors including at least one connector at a left side of the bib and at least one connector at a right side of the bib, and wherein the rear portion of the bib include a plurality of connectors including at least one connector at the left side of the bib and at least one connector at the right side of the bib;

only a single shoulder strap having connectors each configured to releasably couple to any of the connectors at either the front portion of the bib or the rear portion of the bib, wherein the wader does not include a second shoulder strap; and an adapter strap having a plurality of connectors in which at least one of the connectors is of a different configuration such that said one of the connectors is configured to releasably couple to one of the connectors of the shoulder strap and the other connectors of the adapter strap are configured to releasably couple to the connectors at the front portion of the bib or the rear portion of the bib;

wherein the shoulder strap is configured to support both the left side and the right side of the bib when the adapter strap is releasably coupled the shoulder strap and to either the front portion of the bib or the rear portion of the bib and the shoulder strap is coupled to the other of the front and rear portions of the bib.

6. The wader of claim 5, wherein the plurality of connectors of the adapter strap include at least three buckles.

7. The wader of claim 6, wherein at least one of the buckles includes a swivel buckle.

8. A wader, comprising:

a bib including a front portion and a rear portion, at least one of the front and rear portions having a connector at a right side of the bib and a left side of the bib;

only a single shoulder strap having opposite ends and a connector at each end which is configured to releasably couple to any one of the connectors at the front and rear portions of the bib, wherein the wader does not include a second shoulder strap; and an adapter strap having a plurality of connectors including at least one connector configured to releasably couple to the connectors of the shoulder strap and at least two connectors configured to releasably couple to the right and left side connectors at either of the front and rear portions of the bib;

wherein the shoulder strap is configured to support both the right and left sides of the bib when the connector at one end of the shoulder strap is coupled to a single one of the connectors at either the front or rear portions of the bib while the connector at the other end of the shoulder strap is coupled to the at least one mating connector of the adapter strap and the at least two mating connectors of the adapter strap are coupled to the left and right connectors of the front or rear portions of the bib.

9. The wader of claim 8, wherein the connectors of the shoulder strap are buckles.

10. The wader of claim 9, wherein the buckles include at least one swivel buckle.

11. The wader of claim 1, wherein the adapter strap includes a continuous strap connected between the second buckle and the third buckle.

12. The wader of claim 5, wherein the adapter strap includes a continuous strap that couples together the plurality of connectors of the adapter strap.

13. The wader of claim 8, wherein the adapter strap includes a continuous strap that couples together the plurality of connectors of the adapter strap.

* * * * *